United States Patent [19]

Blomstrom

[11] 4,026,380

[45] May 31, 1977

[54] TILTING OPERATOR PLATFORM SAFETY LOCK

[75] Inventor: Gary D. Blomstrom, Waverly, Nebr.

[73] Assignee: Caterpillar Tractor Co., Peoria, Ill.

[22] Filed: Dec. 8, 1975

[21] Appl. No.: 638,581

[52] U.S. Cl. ..... 180/89.12; 296/28 C

[51] Int. Cl.[2] ..... B62D 39/00

[58] Field of Search ..... 180/89 R, 89 A, 77 TC; 296/28 C, 35 R, 102; 292/278, 338

[56] References Cited

UNITED STATES PATENTS

| | | | |
|---|---|---|---|
| 2,939,541 | 6/1960 | Smalley | 180/89 A |
| 2,947,376 | 8/1960 | Norrie | 180/89 A |
| 3,039,557 | 6/1962 | Boyce | 180/89 A |
| 3,578,377 | 5/1971 | Babbitt | 296/102 |
| 3,875,850 | 4/1975 | Reynolds | 91/468 |

*Primary Examiner*—Joseph F. Peters, Jr.
*Assistant Examiner*—R. Schrecengost
*Attorney, Agent, or Firm*—Wegner, Stellman, McCord, Wiles & Wood

[57] ABSTRACT

A locking mechanism to prevent accidental lowering of a tiltable operator's cab of an earthmoving vehicle. The locking mechanism includes an elongate rod secured to one end of the cab for movement therewith and a latch. The latch is resiliently urged toward a locked position, but is prevented from moving thereto by blocking engagement with the side of the rod, until a selected tilted position is reached, and a free end of the rod is aligned with the latch. Upon alignment, the latch automatically springs to its locked position underlying the end of the rod thereby preventing downward movement of the rod and the cab supportable thereby. The one end of the rod is mounted to the cab for pivotal movement relative thereto about an axis substantially coincident with that of a pivotal mount for a hydraulic ram energizable to raise the cab.

6 Claims, 4 Drawing Figures

4.
24
50
58
54
52
48
10
108
36
106
88
40
38
84
80
64
36
22
76
75
82
96
90
4.

36
90
92
94
88
38
40
84
64
80
76
82
98
96

TILTING OPERATOR PLATFORM SAFETY LOCK

BACKGROUND OF THE INVENTION

This invention relates to a locking mechanism to prevent accidental lowering of a tilted operator's cab of an earthmoving vehicle, and, more particularly, to such a locking mechanism which is automatically operable to prevent downward movement of the cab upon the cab being raised to a selected, tilted maintenance position.

Operators' cabs on earthmoving vehicles are often pivotally mounted on the vehicle frame to facilitate access to vehicle components which underlie the cab when in a substantially horizontal operating position. A hydraulic jack or other lifting element is used to raise the cab to a tilted maintenance position in which the vehicle components are exposed whenever maintenance work and repairs thereto are required. Typically, means are provided to prevent accidental lowering of the cab. Examples of such lowering prevention means are shown in U.S. Pat. No. 3,875,850 issued Apr. 8, 1975, to Reynolds et al and in U.S. Pat. No. 3,578,377 of Babbitt, Jr., et al, issued Jan. 13, 1969, to Caterpillar Tractor Co., the assignee of the present invention.

SUMMARY OF THE INVENTION

The principal object of the present invention is to provide a mechanism to prevent unwanted lowering of an operator's cab of an earthmoving vehicle which is automatically operable to lock the cab against downward movement upon the cab being raised to a selected tilted maintenance position.

In keeping with this object, the mechanism is provided with a support member carried by the cab for movement therewith, a latch mounted on the frame for movement between locked and unlocked positions, and means for causing the latch to automatically move to its locked position upon the cab being raised to the selected tilted position. The latch, when in the locked position, engages the support member to prevent downward movement thereof beyond a position corresponding to the selected tilted position. The latch supports the support member, and the support member, in turn, supports the cab.

An advantageous feature of the locking mechanism is that the latch is biased to move to its locked position such that it is only returned to its unlocked position to permit downward movement of the cab by the conscious application of force thereto overcoming the bias. A further feature is that a determination of whether the latch is in its locked position can easily be made by visual inspection.

In the illustrative embodiment of the locking mechanism, the latch is pivotally mounted and spring-biased to move to its locked position. The support member is normally held in blocking engagement with the latch by a guide which thereby prevents latch movement until the cab is raised to its selected tilted position. At that point, a shoulder on the support member is aligned with the latch, the blocking engagement is removed, and the latch springs to a position underlying the shoulder. Engagement with the latch prevents downward movement of the support member, and thus downward movement of the operator's cab.

Yet another feature of the locking mechanism is that one end of the support member is mounted to the cab for pivotal movement relative thereto about an axis substantially coincident with the pivot axis of a pivotal mount for a hydraulic jack used to raise the cab. The pivot axis of the support member is adjacent the pivotal mount of the cab to minimize the requisite length of the support member.

The foregoing advantageous features will be made more apparent and further advantageous features will become apparent from the description of the preferred embodiment.

BRIEF DESCRIPTION OF THE DRAWING

The description of the preferred embodiment is given with reference to the several views of the drawing, in which.

DESCRIPTION OF THE PREFERRED EMBODIMENT

Figure 1:
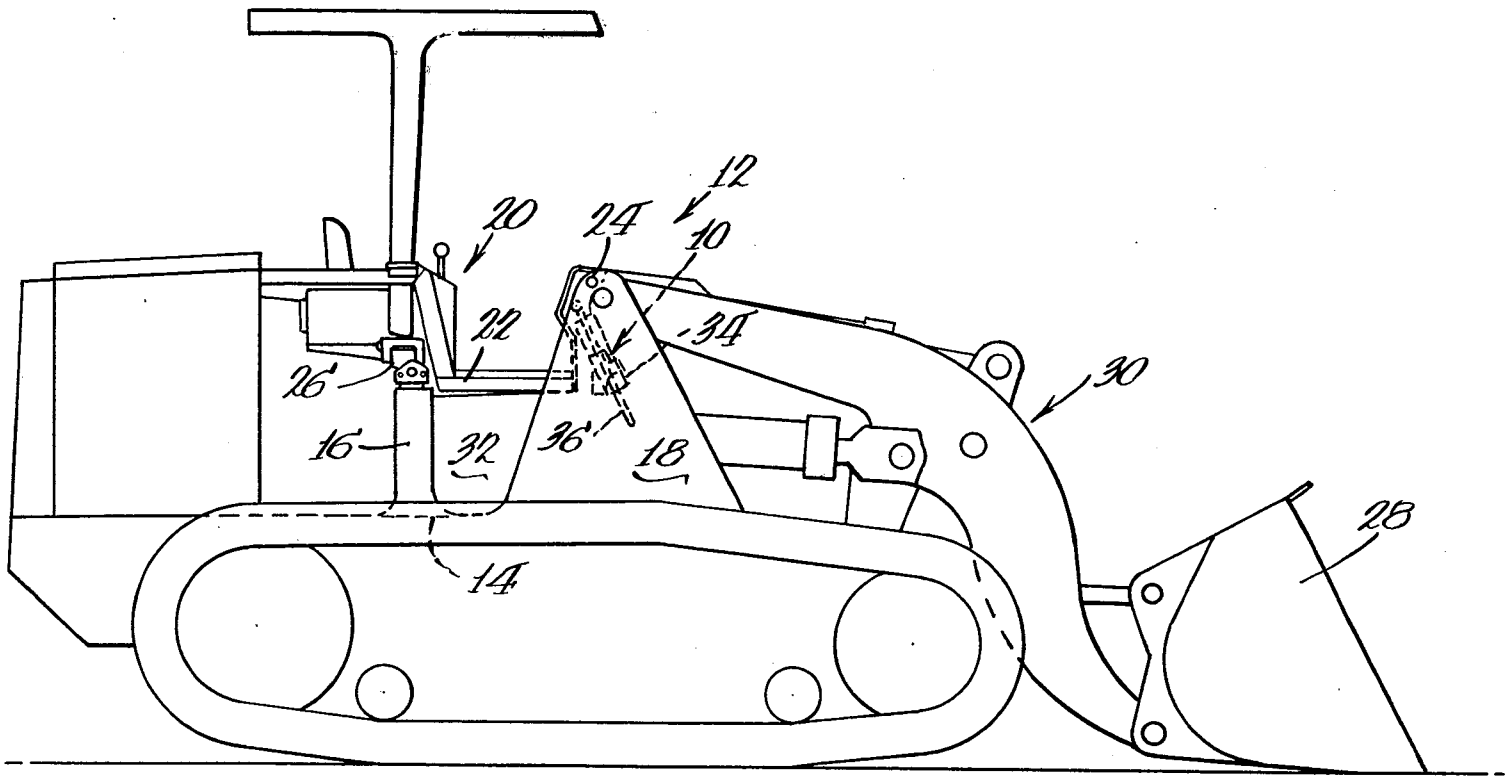
FIG. 1 is a side elevational view of a rear engine loader with a tiltable operator's cab employing the locking mechanism of the present invention.

One embodiment of a locking mechanism 10 made according to the present invention is seen in FIG. 1 as employed on a rear engine loader 12. Rear engine loader 12 includes a symmetrical frame 14 with a pair of pedestals 16 and a pair of upwardly projecting arms 18. An operator's cab 20 includes a platform 22 tiltably mounted at a forward end thereof by means of a pair of pivotal mounts 24 at the respective ends of arms 18. The rear end of cab 20 is supported above the frame 14 by a pair of releasable mounts 26, which may be of conventional construction, at the respective ends of pedestals 16. Earthmoving capability is provided by means of a bucket 28 carried at the end of a bucket linkage 30.

Conventionally located beneath platform 22 in the area indicated by reference numeral 32 between pedestals 16 and arms 18 of frame 14 are a large number of hydraulic elements, circuitry and other vehicle components (not shown). A hydraulic jack 34 is provided to tilt the cab 20 forwardly to gain access to area 32 for maintenance and repair of the vehicle components thereat.

Figure 2:
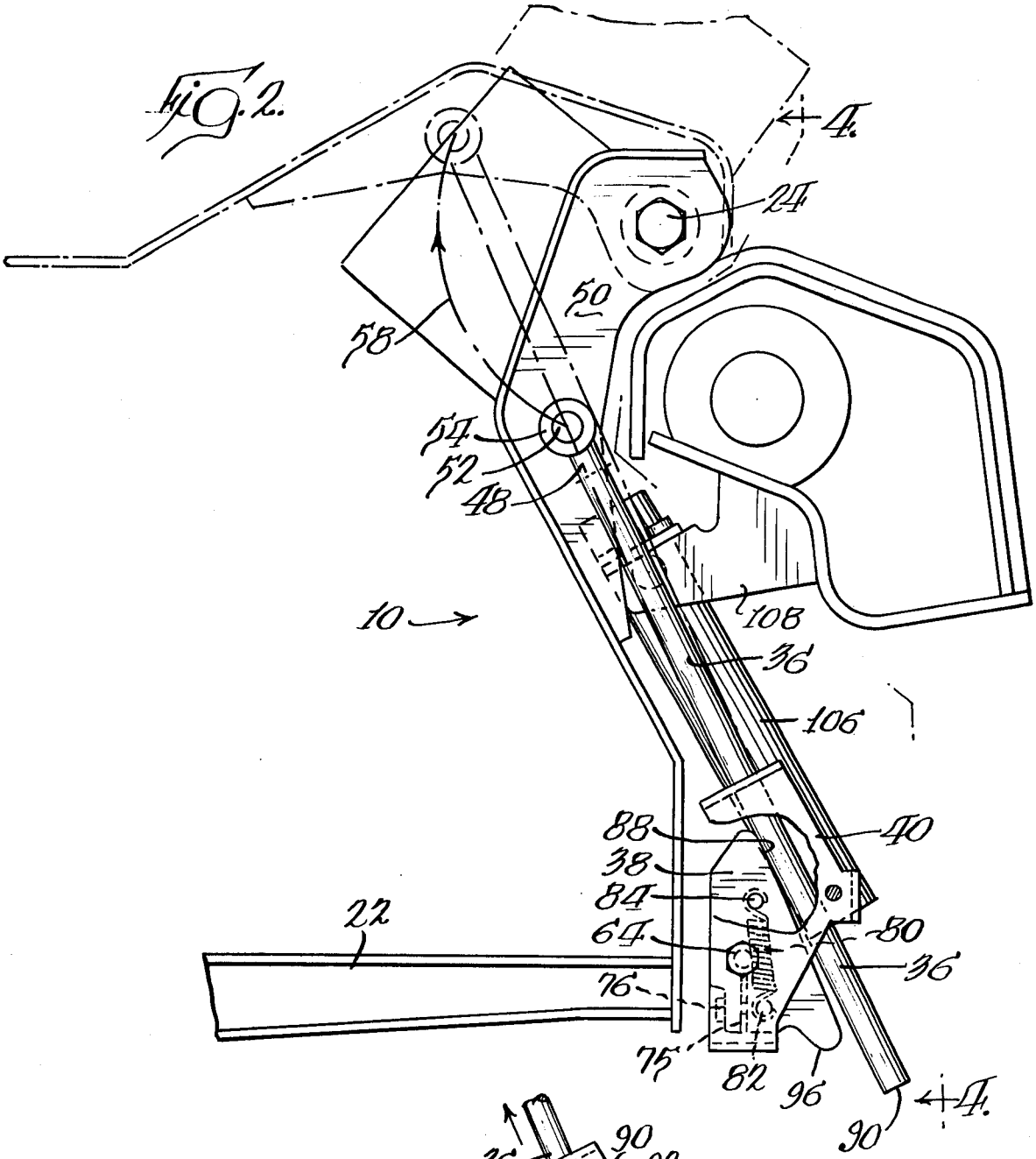
FIG. 2 is an enlarged, fragmentary side elevation of a portion of the loader of FIG. 1, with parts broken away for clarity, illustrating in solid line the locking mechanism when the cab is in the horizontal position, and illustrating in broken line the locking mechanism when the cab is in a partially tilted position.
Figure 4:
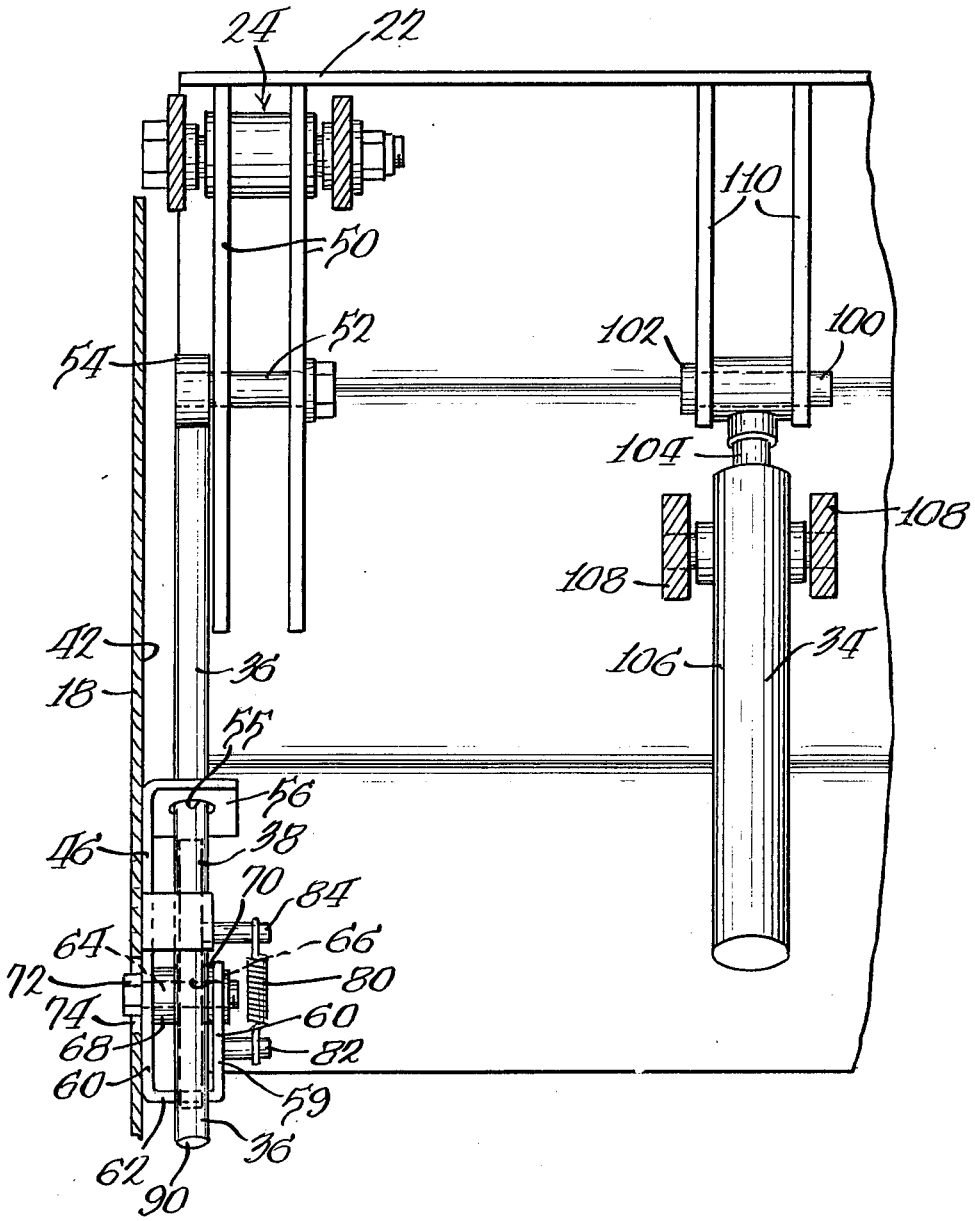
FIG. 4 is a view taken approximately along section line 4—4 of FIG. 2.

Referring now to FIGS. 2 and 4, the locking mechanism 10 is seen to include an elongate support member or rod 36, a latch 38 and a mounting bracket 40 secured to the inner side 42 of one of arms 18.

The rod 36 is carried by cab 20 for movement therewith. One end 48 of rod 36 is pivotally mounted to a pair of downwardly extending plates 50 of platform 22 by means including pivot pin 52. Pivot pin 52 extends through plates 50 and is rotatably received within a cylindrical bearing 54 secured to end 48. The rod 36 extends downwardly from end 48 through a hole 55 in a guide plate 56 of mounting bracket 40. The transverse dimension of guide plate hole 55 is greater than that of rod 36 such that the rod 36 is permitted to slide therethrough as the cab is raised to a tilted position, as illustrated in broken line in FIG. 2. While some rocking motion of rod 36 is permitted as end 48 is moved in an arcuate path 58 between operating and tilted positions, the guide plate 56 substantially restrains the segment of rod 36 there-beneath from moving away from latch 38.

Mounting bracket 40 has a U-shaped section 59 defined by a pair of spaced arms 60 extending upwardly from opposite ends of a cross member 62. Latch 38 is pivotally supported by means of a pivot pin 64 extending through a suitable aperture 66 in a portion of latch 38 received between arms 60 and through aligned apertures in arms 60. A pair of spacers 68 and 70 are provided to keep latch 38 in a selected axial position on the pin 64. Pin 64 terminates at one end thereof with a bolt head 72 which extends through an access opening 74 in arm 18.

Latch 38 is fixedly secured to pin 64 so that rotation of bolt head 72 in a counterclockwise direction, as viewed in FIG. 2, will cause pivotal movement of latch 38. A slot 75 communicating with the aperture 66 divides latch 38 into two segments on opposite sides thereof. A bolt 76 extends through one part of latch 38 across the slot 75 and into the other part of latch 38. By tightening bolt 76, the two parts of the aperture are squeezed together and tightened against pin 64.

Figure 3:
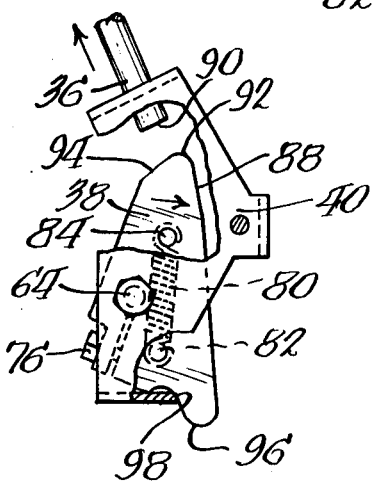
FIG. 3 is a fragmentary side elevation of a part of the locking mechanism including the latch and illustrating the latch in its locked position.

A coil tension spring 80 urges latch 38 to move in a clockwise direction toward its locked position, as shown in FIG. 3. Coil tension spring 80 is secured at one end to a post 82 carried by the innermost one of arms 60 and secured at its other end to a post 84 carried by latch 38.

As best seen in FIG. 4, the spacers 68 and 70 maintain latch 38 in alignment with the side of rod 36. The side of rod 36 therefore engages a blocking surface 88 of latch 38. This blocking engagement prevents the latch from moving to its locked position so long as the cab is beneath the selected tilted maintenance position.

The length of rod 36 is selected such that upon the cab being raised to the selected tilted position, the free end 90, which acts as a shoulder, is aligned with latch 38 slightly above the top 92 of blocking surface 88, thus terminating the blocking restraint. When the blocking restraint is removed, spring 80 causes latch 38 to spring to its locked position, as seen in FIG. 3, with a load-bearing surface 94 thereof underlying the free end 90. Overtravel of latch 38 is prevented by means of engagement of a stop tab 96 of latch 38 with a stop surface 98 at the forward edge of cross member 62.

Engagement of load-bearing surface 94 with the end 90 of rod 36 prevents downward movement of rod 36 to ultimately support the cab 20. With rod 36 disengaged from load-bearing surface 94, the latch may be returned to its unlocked position to allow lowering of the cab. Return of the latch 38 to the unlocked position is achieved by applying a counterclockwise rotary force to bolt head 72.

Referring particularly to FIG. 4, it is seen that the pivot pin 52 at end 48 of rod 36 is located adjacent the pivotal mount 24 of cab 20 to minimize the requisite length of rod 36. Further, the axis of pin 52 of mount 35 is substantially coincident with the axis 100 of a pivotal mount 102 of hydraulic jack 34. The piston element 104 of hydraulic jack 34 is secured to pivotal mount 102. Pivotal mount 102, in turn, is supported between a pair of plates 110 of platform 22. The cylinder element 106 of jack 34 is secured to a part 108 of the frame 14.

I claim:

1. In a vehicle having a frame, a cab overlying the frame, and means for mounting the cab for pivotal movement relative thereto between an operating position and a tilted position, a locking mechanism to prevent lowering of the cab from a selected tilted position, comprising:

an elongated support having an end mounted on one of the frame and the cab for movement relative to the other of the cab and the frame, in a predetermined path, when the cab is moved on the frame, said support having a shoulder remote from said end;

a latch movably mounted adjacent said path on the other of the cab and the frame and including a latch surface movable into and out of said path, said latch surface, when in said path, engaging said shoulder to preclude relative movement of said support and said latch in at least one direction; and means for causing such latch surface to move into said path upon predetermined relative movement between said cab and said frame.

2. The vehicle of claim 1 wherein said causing means comprises means for biasing said latch surface into said path and further including a blocking surface on said support slidably engaging said latch for precluding movement of said latch surface into said path except when said latch surface and said shoulder are aligned.

3. The vehicle of claim 1 wherein said latch comprises a pivotally mounted lever having said latch surface thereon, said latch surface being in slidable engagement with the side of the support, means biasing said latch surface into said path, and a stop means for preventing overtravel of said lever.

4. The vehicle of claim 1 further including a movable operator for said latch for moving said latch surface out of said path, said operator being constructed and arranged to be movable substantially only when force is applied thereto by a tool to minimize the possibility that said latch surface will be moved out of said path through inadvertence.

5. The vehicle of claim 4 wherein said latch is pivotally mounted and wherein said operator comprises a bolt secured to said latch.

6. The vehicle of claim 1 further including a mounting bracket movably said latch and secured to the other of said cab and said frame, said mounting bracket including an aperture slidably receiving said support and guiding said support in said path.

* * * * *

UNITED STATES PATENT AND TRADEMARK OFFICE

CERTIFICATE OF CORRECTION

PATENT NO. : 4,026,380

DATED : May 31, 1977

INVENTOR(S) : Gary D. Blomstrom

It is certified that error appears in the above-identified patent and that said Letters Patent are hereby corrected as shown below:

Column 3, line 5, "there-beneath" should read --therebeneath--.

Column 4, line 55, after "movably" insert --mounting--.

Signed and Sealed this

First Day of November 1977

[SEAL]

*Attest:*

RUTH C. MASON
*Attesting Officer*

LUTRELLE F. PARKER
*Acting Commissioner of Patents and Trademarks*